US009573002B2

(12) United States Patent
Lefebvre et al.

(10) Patent No.: US 9,573,002 B2
(45) **Date of Patent: *Feb. 21, 2017**

(54) SELF-BLOCKING DESCENDER-BELAY DEVICE

(71) Applicant: ETABLISSEMENTS SIMOND, Les Houches (FR)

(72) Inventors: Patrick Lefebvre, Chamonix Mont Blanc (FR); Mathieu Mansuy, La Bresse (FR); Romain Molliex, Scionzier (FR)

(73) Assignee: ETABLISSEMENTS SIMOND, Les Houches (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/506,747

(22) Filed: Oct. 6, 2014

(65) Prior Publication Data

US 2015/0096838 A1 Apr. 9, 2015

(30) Foreign Application Priority Data

Oct. 7, 2013 (FR) ..... 13 59723

(51) Int. Cl.
*A62B 1/14* (2006.01)
*A63B 29/02* (2006.01)

(52) U.S. Cl.
CPC *A62B 1/14* (2013.01); *A63B 29/02* (2013.01)

(58) Field of Classification Search
CPC ..... A62B 1/14; A62B 1/00; A62B 1/06; A62B 35/00; A62B 35/04; A62B 35/006; A62B 35/0025; A62B 35/0037; A62B 35/0075; A62B 35/0081; A63B 29/00; A63B 29/02
See application file for complete search history.

(56) References Cited

U.S. PATENT DOCUMENTS 3,814,210 A * 6/1974 Hoffman ..... A62B 1/14 182/135
4,059,871 A * 11/1977 Swager ..... A62B 1/14 182/5

(Continued)

FOREIGN PATENT DOCUMENTS

EP 0803268 A1 10/1997
EP 0688581 B1 9/1999
JP 2011200640 A 10/2011

*Primary Examiner* — Daniel Cahn
(74) *Attorney, Agent, or Firm* — William H. Eilberg

(57) ABSTRACT

The self-blocking descender-belay device (1) according to the invention comprises:

a first lateral guide flange (6) for the rope, comprising a braking nose (4*e*), a second lateral guide flange (7) for the rope, which is separated from the first flange (6) by a transverse gap (8) for passage of the rope, and can be displaced between a spaced position for putting into place and removal of a rope, and a closed position in which the rope is trapped in the transverse gap (8) for passage of the rope, a cam (4*d*) which is engaged between the first and second flanges (6, 7) and is mobile towards and away from the braking nose (4*e*), and is thrust towards the braking nose (4*e*) by a cam return spring, the transverse gap (8) for passage of the rope extending between a rope input in the vicinity of the braking nose (4*e*), and a rope output opposite, the rope output having a large opening such as to permit free orientation of the rope output end between a blocking orientation in which the rope surrounds the cam (4*d*), and a release orientation in which the rope passes through the transverse gap (8) for passage of the rope directly, and without thrusting the cam (4*d*) towards the braking nose (4*e*).

10 Claims, 12 Drawing Sheets

(56) References Cited

U.S. PATENT DOCUMENTS 4,413,382 A * 11/1983 Siegmann ..... B63B 21/08 24/132 R
4,560,029 A * 12/1985 Dalmaso ..... A62B 35/04 182/112
5,076,400 A * 12/1991 Petzl ..... A62B 1/14 188/65.5
5,156,240 A * 10/1992 Ostrobrod ..... A62B 1/14 182/193
5,544,723 A * 8/1996 Gettemy ..... A62B 1/14 188/65.1
6,155,384 A * 12/2000 Paglioli ..... A62B 1/14 188/65.2
6,505,384 B1 * 1/2003 Renton ..... B63B 21/04 114/218
6,843,346 B2 * 1/2005 LeBeau ..... A62B 1/14 182/192
6,899,203 B1 * 5/2005 Golden ..... A62B 1/14 182/5
7,108,099 B2 * 9/2006 Ador ..... A62B 1/14 182/192
8,375,526 B2 * 2/2013 Everett ..... A62B 1/14 182/192
8,387,751 B2 * 3/2013 Miceli ..... A62B 1/14 182/192
8,950,550 B2 * 2/2015 Maurice ..... A62B 1/14 182/193
9,160,149 B2 * 10/2015 Iwama ..... B25B 25/00
2002/0112917 A1 * 8/2002 Ador ..... A62B 1/14 182/5
2005/0262669 A1 * 12/2005 Thompson ..... A63B 29/02 24/134 R
2006/0207829 A1 * 9/2006 Mauthner ..... A62B 1/14 182/5
2007/0119653 A1 * 5/2007 Brown ..... A62B 1/14 182/36
2007/0215411 A1 * 9/2007 Petzl ..... A62B 1/14 182/193
2011/0048852 A1 * 3/2011 Wolf ..... A62B 1/14 182/5
2011/0073417 A1 * 3/2011 Chaumontet ..... A62B 1/14 188/65.5
2013/0219671 A1 * 8/2013 Hutin ..... A62B 1/14 24/134 KB
2014/0020983 A1 * 1/2014 Casebolt ..... A62B 1/14 182/241
2014/0020988 A1 * 1/2014 Casebolt ..... A62B 35/0081 188/65.1
2014/0138191 A1 * 5/2014 Chabod ..... A62B 1/14 188/65.1
2015/0275580 A1 * 10/2015 Canfield ..... E06C 7/186 182/8
2016/0130875 A1 * 5/2016 Hwang ..... E06C 7/186 182/5
2016/0287913 A1 * 10/2016 Bell ..... A62B 1/14

* cited by examiner

SELF-BLOCKING DESCENDER-BELAY DEVICE

TECHNICAL FIELD OF THE INVENTION

The present invention relates to a self-blocking descender-belay device which is designed to be used to control the paying-out of a rope, for example for the descent of a person down a rope, or for belaying of a person.

Various descender-belay device structures are already known, for example such as that which is described in document EP 0 688 581 B1.

A known descender-belay device of this type comprises:

- a first lateral guide flange for the rope, comprising a braking nose,
- a second lateral guide flange for the rope, which is separated from the first flange by a transverse gap for passage of the rope, and can be displaced between a spaced position for putting into place and removal of the rope, and a closed position in which the rope is trapped in the transverse gap for passage of the rope,
- a cam which is engaged between the first and second flanges and is mobile towards and away from the braking nose,
- a cam manoeuvring unit, which can be activated by a user in order to displace the cam away from the braking nose,
- a cam return spring, in order to thrust the cam in its movement between the first and second flanges,
- the transverse gap for passage of the rope extending between a rope input in the vicinity of the braking nose, and a rope output in the vicinity of the cam,
- the rope output being formed such as to permit orientation of the output end of the rope according to a blocking orientation in which the rope passes through the transverse gap for passage of the rope, whilst enveloping the cam, and thrusting it towards the braking nose,
- at least one of the first and second flanges extending longitudinally from a connection end, where there are situated the braking nose, the cam and the transverse gap for passage of the rope, to a coupling end where coupling means are situated.

In this known descender-belay device, the cam return spring thrusts the cam away from the braking nose, in order to assist the sliding of the rope in the absence of tension on the rope.

When the cam manoeuvring unit is released during a movement of descent down the rope, the tension on the rope thrusts the cam towards the braking nose, such that the rope is pressed by the cam against the braking nose. This results in braking of the movement of descent.

However, it is found in this device that the automatic triggering of the braking requires tension of the rope which is sufficiently sudden and strong to drive the cam against its return spring. In the presence of reduced tension, or relatively slow application of the tension of the rope, the blocking of the rope does not take place, and the self-blocking function is not fulfilled.

On the other hand, the deliberate reduction of braking by the user is not regular. Firstly, by using the cam manoeuvring unit in order to allow the rope to pay out with braking, the paying-out of the rope is relatively jerky. Secondly, in order to supply a climber with free rope, it is necessary to inhibit the braking. This leads the user to act directly with his hand on the cam, in order to space it from the braking nose, with the risk of forgetting to release the hand when blocking is necessary.

A device according to the preamble of claim 1 is also known from document JP 2011-200 640 A. In this document, the objective is essentially to ensure automatic blocking of the rope in the absence of thrusting on the cam by the user. For this purpose, the path for passage of the rope is permanently in the form of an arc of a circle, irrespective of the orientation of the output end of the rope. The cam is arranged halfway between the two longitudinal ends of the body of the device. The paying-out of the rope is permitted only if the user thrusts the cam in rotation. Thus, this device does not make it possible to control easily the braking of the rope in order to allow it to be paid out regularly with or without a load.

The object of the present invention is to eliminate the disadvantages of the known descender-belay devices, whilst making it possible to fulfill efficiently the two contradictory functions of a descender-belay device, i.e. great ease and efficiency in permitting the deliberate paying-out of a rope, and secure blocking of the rope as soon as tension occurs, and in the absence of intervention by the user, even in the presence of a slight tension and/or a slow speed of paying-out of the rope.

It will be appreciated that these two functions are contradictory, in that easy paying-out of the rope needs great ease of spacing of the cam from the braking nose, whereas secure blocking requires great ease of displacement of the cam towards the braking nose.

SUMMARY OF THE INVENTION

In order to achieve these objectives and others, the invention proposes a self-blocking descender-belay device to control the paying-out of a rope, comprising:

- a first lateral guide flange for the rope, which is integral with a braking nose,
- a second lateral guide flange for the rope, which is separated from the first lateral guide flange for the rope by a path for passage of the rope, and can be displaced between a spaced position for putting into place and removal of the rope, and a closed position in which the rope is trapped in the transverse gap for passage of the rope,
- a cam which is engaged between the first and second lateral guide flanges for the rope, and is mobile towards and away from the braking nose, from which it is separated by an intermediate section of path,
- a cam manoeuvring unit, which can be activated by a user, in order to displace the cam away from the braking nose,
- a cam return spring, in order to thrust the cam towards the braking nose, in its movement between the first and second flanges,
- the path for passage of the rope extending on both sides of the intermediate section of path, between a path input in the vicinity of the braking nose, and a path output,
- the path output comprising a blocking output portion which passes round the cam, and along which there can pass an output end of the rope, which thus thrusts the cam towards the braking nose,
- at least one of the first and second flanges extending longitudinally from a connection end, where there are situated the braking nose, the cam and the path for passage of the rope, to a proximal end area where coupling means are situated;

and in addition, according to the invention:

- the path output extends laterally according to a large opening, between the first and second flanges, from the blocking output portion, to a release output portion which is in line with the path input and the intermediate section of path, in order to define a generally straight passage, along which the output end of the rope can pass directly, without thrusting the cam towards the braking nose.

As a result of the presence of the cam return spring, which thrusts the cam towards the braking nose, contrary to the arrangement indicated in the prior document EP 0 688 581 B1, in the absence of thrusting by the user the automatic blocking of the rope is ensured even in the presence of a slight tension or a slow speed of paying-out, since the spring gives rise to the start of the blocking, which then makes the descender-belay device pivot to a blocking position, in which the start of the blocking is immediately completed by the force exerted on the cam by the taut rope. The resilient thrust of the cam towards the braking nose thus reduces the blocking time very substantially, and prevents blocking faults.

Simultaneously, thanks to the wide path output which permits free orientation of the output end of the rope, contrary to the prior documents, the descender-belay device can be oriented deliberately by the user away from the blocking position, in order to provide it with a release orientation, in which the output end of the rope is in the extension of the rope input, and thus avoids thrusting the cam towards the braking nose, consequently ensuring efficient and adjustable release, even in the presence of the residual braking caused by the thrust of the cam return spring.

As a result, the range of non-triggering of the blocking of a descender-belay device of this type is reduced, and it exists only in the case when the user maintains the descender-belay device in the release orientation, whereas, as soon as the user releases the descender-belay device in the presence of tension of the rope, the rope automatically goes into the blocking orientation in which the rope envelops the cam, and ensures immediate blocking.

According to a first embodiment, in its movement towards and away from the braking nose, the cam can be guided by guide slides.

According to a preferred embodiment, the cam is mobile in rotation around a rotational cam shaft, which, in relation to the cam, is situated on the other side of the intermediate section of path, and is offset in the direction of the proximal end area.

A movement of rotation of this type is simple to carry out and to reproduce reliably, even in the presence of mud, dust, or foreign bodies which can oppose the movement of the cam. In addition, the cam is thus efficiently thrust by the rope in an appropriate manner in the two situations of blocking and release.

Preferably, the cam is supported by the second lateral guide flange for the rope.

In this case, the cam is advantageously associated with a first cam lug, which is displaced in an aperture in the form of an arc of a circle provided in the second lateral guide flange for the rope, such as to guide the cam, and to take over some of the traction forces withstood by the descender-belay device.

According to the invention, means are provided for locking the flanges in the closed position, such as to prevent any risk of untimely opening of the descender-belay device, which opening would be liable to release the rope.

According to an advantageous embodiment, this locking can be ensured by the cam itself, by associating the cam with a second cam lug which is displaced on a guide path provided in the first lateral guide flange, and by providing the guide path with two successive guide sections, i.e.:

a first section for guiding according to the movement of rotation of the cam on the second flange around the rotational cam shaft, a second section for guiding according to a movement of rotation of the second flange relative to the first flange around a flange shaft, the rotational cam shaft and the flange shaft being spaced apart from one another, and the second guide section being connected to the first guide section by an angle which is not zero.

Since the cam is thrust back by the cam return spring, the second cam lug is at the beginning of the first guide section, and opposes the rotation of the second flange, such that, by means of its second cam lug, the cam itself ensures a first locking of the second flange in the closed position.

Advantageously, a button can additionally be provided for unlocking of the second lateral guide flange relative to the first lateral guide flange.

Advantageously, the cam manoeuvring unit can comprise a lever which is articulated on one of the lateral guide flanges, and is connected mechanically to the cam, in order to displace the cam away from the braking nose by means of deliberate action by the user. Thus, when the descender-belay device is used as a descender device, the user can regulate the braking of his descent down the rope by manoeuvring the lever.

In this case, the above-mentioned unlocking button can advantageously be covered by the lever when the latter is at rest, thus preventing untimely manoeuvring of the unlocking button which can give rise to unlocking of the second flange relative to the first flange.

Preferably, the flanges have dimensions such that, in the braking position in which the cam clamps the rope against the braking nose, the cam is entirely accommodated in the transverse gap for passage of the rope. This prevents untimely manipulation of the cam away from the braking nose, and makes the user orient the descender-belay device in order to give rise to the release.

BRIEF DESCRIPTION OF THE DRAWINGS

Other objectives, characteristics and advantages of the present invention will become apparent from the following description of particular embodiments, which description is provided in relation with the appended figures, in which.

DESCRIPTION OF THE PREFERRED EMBODIMENTS

Figure 1:
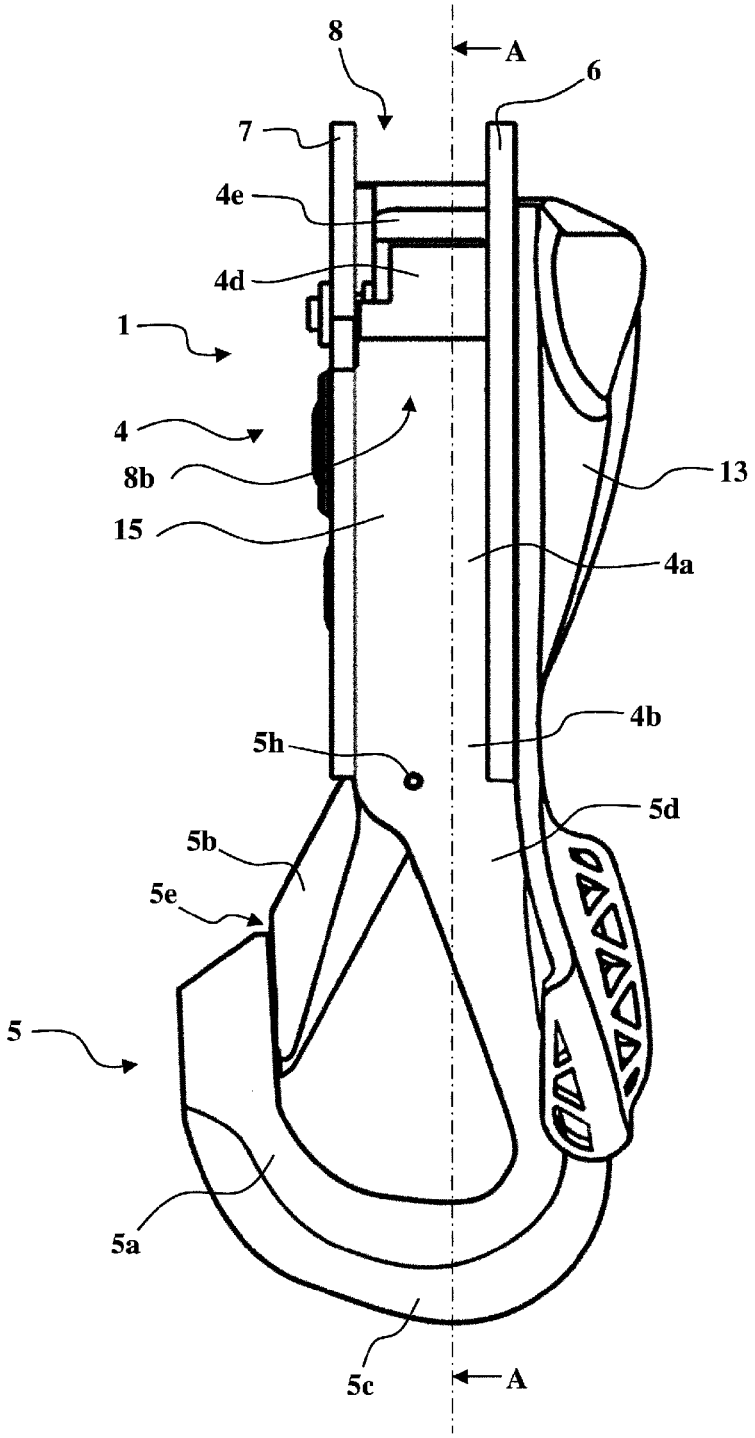
FIG. 1 is a front view of a descender-belay device according to an embodiment of the present invention.
Figure 2:
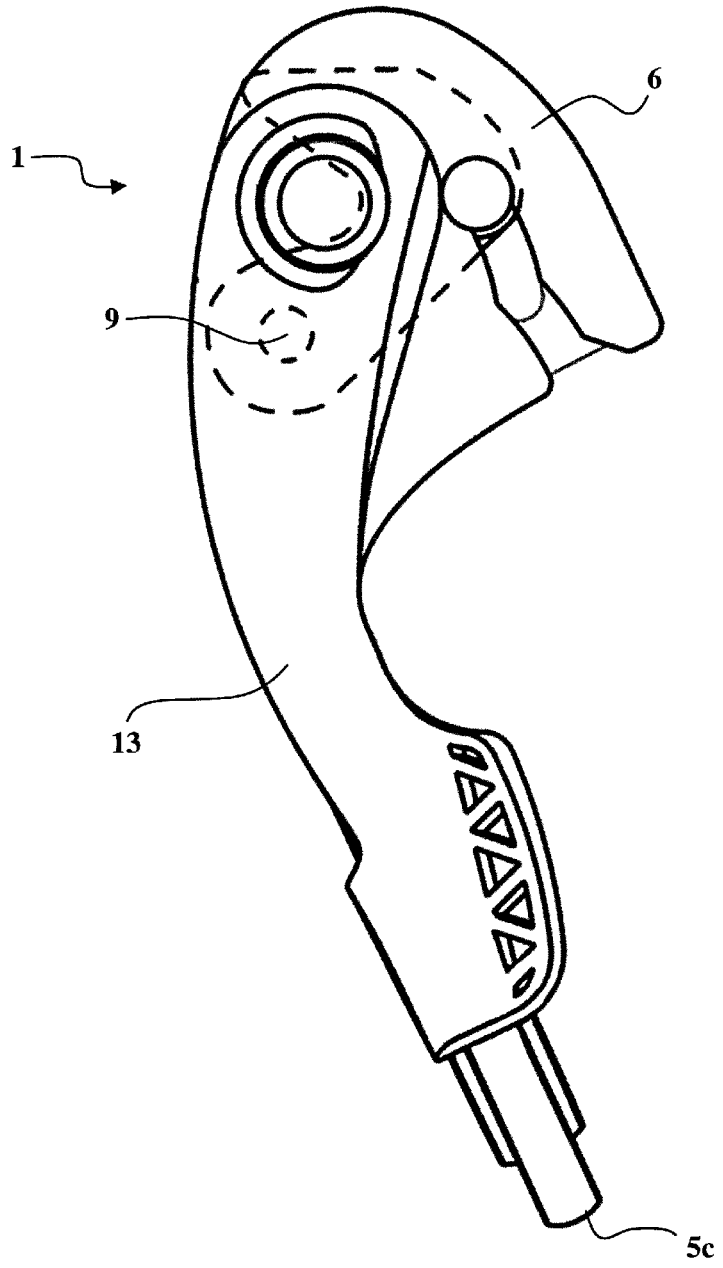
FIG. 2 is a view of the right side of the descender-belay device in FIG. 1.
Figure 3:
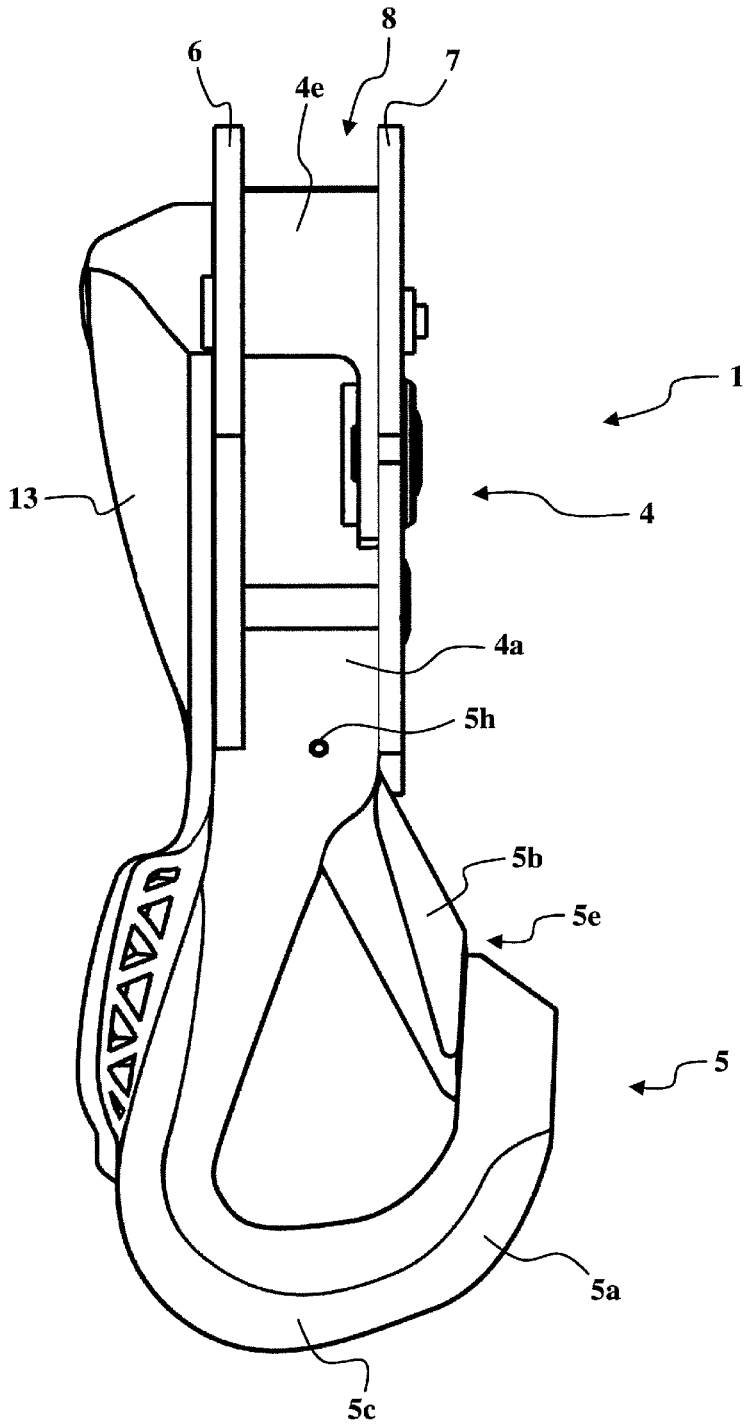
FIG. 3 is a rear view of the descender-belay device in FIG. 1.

In the embodiment illustrated in FIGS. 1 to 12, the self-blocking descender-belay device 1 according to the invention permits control of the paying-out of a rope 3 (FIGS. 5 to 7) in a paying-out direction which is illustrated by the arrow F. Thus, the rope 3 comprises an input end 3A, an output end 3B, and an intermediate section 3C which passes through the self-blocking descender-belay device 1.

In general, the self-blocking descender-belay device 1 comprises a connection device 4 and coupling means 5.

The connection device 4 is formed so as to ensure a connection with a rope 3, whilst controlling the sliding or blocking of the rope 3 in the connection device 4.

The coupling means 5 are formed so as to permit the selective coupling of the descender-belay device 1 either to a fixed point, or to the harness of a user.

The connection device 4 comprises a connection body 4*a* with a proximal end 4*b* which is connected to the coupling means 5.

The connection device 4 additionally comprises second connection means, comprising a braking nose 4*e* which co-operates with a cam 4*d* which is fitted such as to be mobile on the connection body 4*a*, and is designed to press the rope 3 against the braking nose 4*e*.

In the preferred embodiment illustrated in the figures, the coupling means 5 comprise a connector body 5*a*, in the form of an open ring, and a closure finger 5*b*.

The connector body 5*a* extends between a proximal end area 5*c* and a distal end area 5*d*, and has a lateral opening 5*e* (FIGS. 1 and 3) which the finger 5*b* closes in the closed position, and which the finger 5*b* leaves accessible in the open position.

For this purpose, the closure finger 5*b* pivots around an articulation shaft 5*h* which is perpendicular to the general plane of the connector body 5*a* in the form of an open ring.

In the embodiment illustrated, the proximal end 4*b* of the connection body 4*a* forms a continuity with the distal end area 5*d* of the connector body 5*a*, such that the connector body 5*a* and the connection body 4*a* form a unit assembly with a common rigid body formed by the connection body 4*a* and the connector body 5*a*.

As an alternative, coupling means 5 could be designed in the form of a simple aperture provided in the proximal end of the connection body 4*a*, i.e. without a closure finger, this aperture permitting connection by means of a snap clasp in a manner known per se.

The structure of the connection device 4 is now considered.

A first lateral guide flange 6 for the rope is integral with the connection body 4*a*, and integral with the braking nose 4*e*, the first lateral guide flange 6 for the rope preferably being oriented according to a plane perpendicular to the general plane of the connector body 5*a*.

A second lateral guide flange 7 for the rope, parallel to the first lateral guide flange 6 for the rope, is separated from the first lateral guide flange 6 for the rope by means of a transverse path 8 for passage of the rope (FIG. 1). The second lateral guide flange 7 for the rope is fitted such that it can be displaced on the connection body 4*a*, between a spaced position (FIG. 7) for putting into place and removal of the rope, and a closed position (FIGS. 2, 5 and 6) in which the rope is trapped in the transverse path 8 for passage of the rope.

The braking nose 4*e*, which is integral with the first lateral guide flange 6 for the rope, passes through the gap between the first and second lateral guide flanges 6 and 7 for the rope.

The cam 4*d* is engaged between the first and second lateral guide flanges 6 and 7 for the rope, and is fitted such as to be mobile towards and away from the braking nose 4*e*.

Figure 4:
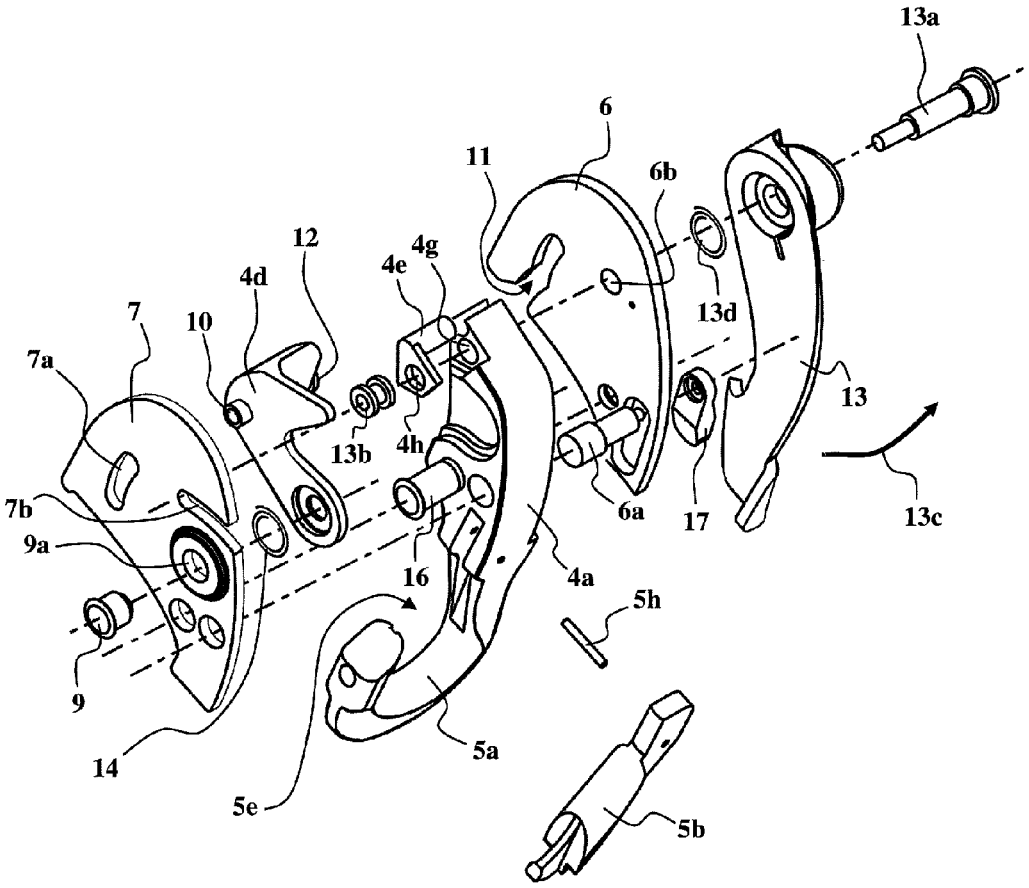
FIG. 4 is an exploded view of the descender-belay device in FIGS. 1 to 3.

In practice, in the embodiment illustrated, the cam 4*d* is supported by the second lateral guide flange 7 for the rope, on which it is mobile in rotation around a rotational cam shaft 9. As illustrated in FIG. 4, the rotational cam shaft 9 can be inserted in an aperture 9*a* in the second lateral guide flange 7 for the rope. The rotational cam shaft 9 (FIG. 6) and the cam 4*d* are situated respectively on both sides of the transverse path 8 for passage of the rope, and the rotational cam shaft 9 is closer to the proximal end area 5*c* than the cam 4*d* is.

In order to reduce the forces withstood by the rotational cam shaft 9, the cam 4*d* is associated with a first cam lug 10, which, during the rotation of the cam 4*d*, is displaced in an aperture in the form of an arc of a circle 7*a* of the second lateral guide flange 7 for the rope (FIG. 4).

The braking nose 4*e* advantageously consists of a steel wear part added onto the connection body 4*a*, which itself is made of aluminium alloy, as can be seen in FIG. 4.

The first lateral guide flange 6 for the rope is added and secured on the connection body 4*a* by rivets such as the rivets 16 and 13*a* (FIG. 4), and it comprises a slot which constitutes a guide path 11 for a second cam lug 12. This guide path 11 and the second cam lug 12 participate in taking over the forces withstood by the cam 4*d*. In addition, the guide path 11 makes it possible to fulfill a second function, i.e. the locking of the second lateral guide flange 7 for the rope in the closed position, as will be explained hereinafter. Thus, the aperture 7*a* and the guide path 11 comprise guide slides for guiding the cam 4.

A lever 13 is articulated on the connection body 4*a* and the first lateral guide flange 6 for the rope, around the rivet 13*a*, thus forming a rotational shaft perpendicular to the plane of the first lateral guide flange 6 for the rope, and is arranged on the outer surface of the first lateral guide flange 6 for the rope. In practice, the rivet 13*a* which forms the rotational shaft of the lever 13 passes through a hole 6*b* in the first lateral guide flange 6 for the rope, and passes through a hole 4*g* in the connection body 4*a* and through a hole 4*h* in the braking nose 4*e*, in order to co-operate with a brace 13*b*, which ensures simultaneously the retention of the rotational shaft 13*a*, the securing of the braking nose 4*e* on the connection body 4*a*, and the guiding of the second flange 7 in sliding in a slot 7*b* in the second lateral guide flange 7 for the rope.

The lever 13 co-operates with the end of the second cam lug 12, which extends from the guide path 11, thus allowing a user to pivot the cam 4*d* away from the braking nose 4*e*, by pivoting the lever 13 in the direction illustrated by the arrow 13*c*.

Thus, the lever 13 constitutes a cam manoeuvring unit which can be activated by a user in order to displace the cam 4*d* away from the braking nose 4*e*.

Figure 8:
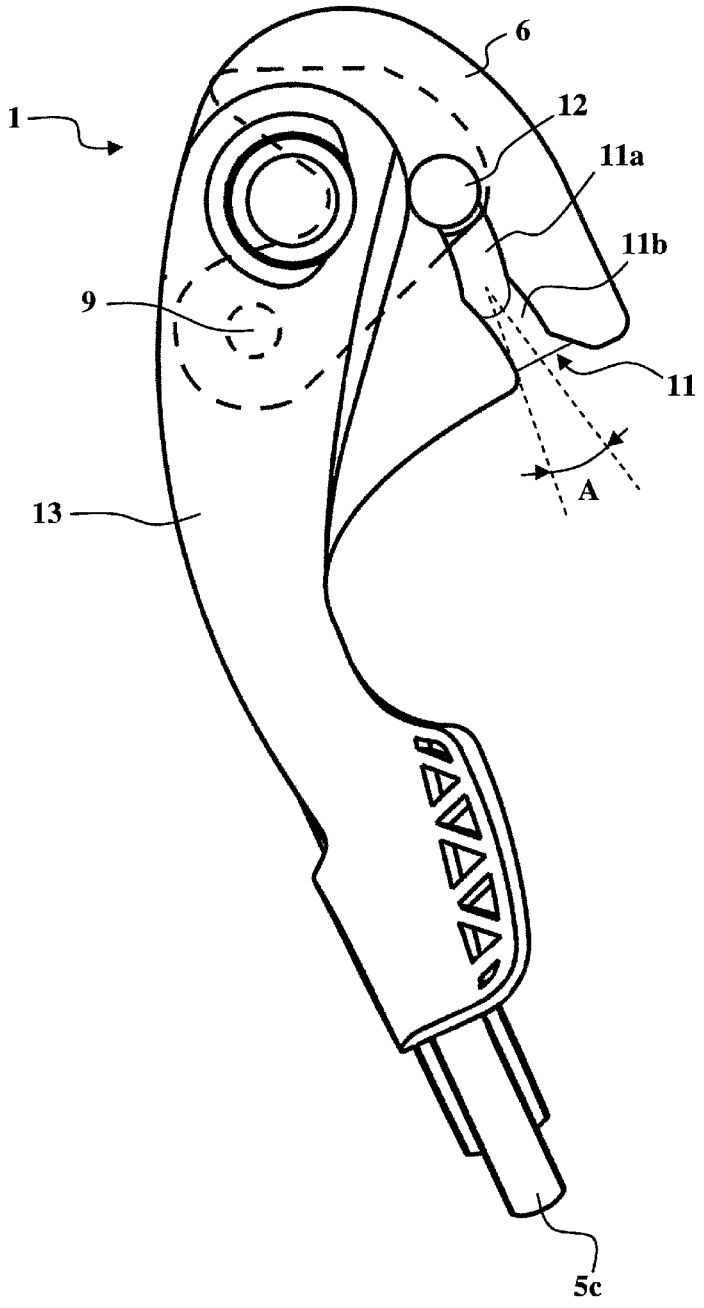
FIGS. 8 to 10 illustrate in a side view respectively the initial step, the intermediate step and the final step of displacement of the second lateral guide flange for the rope during its displacement to the spaced position.
Figure 9:
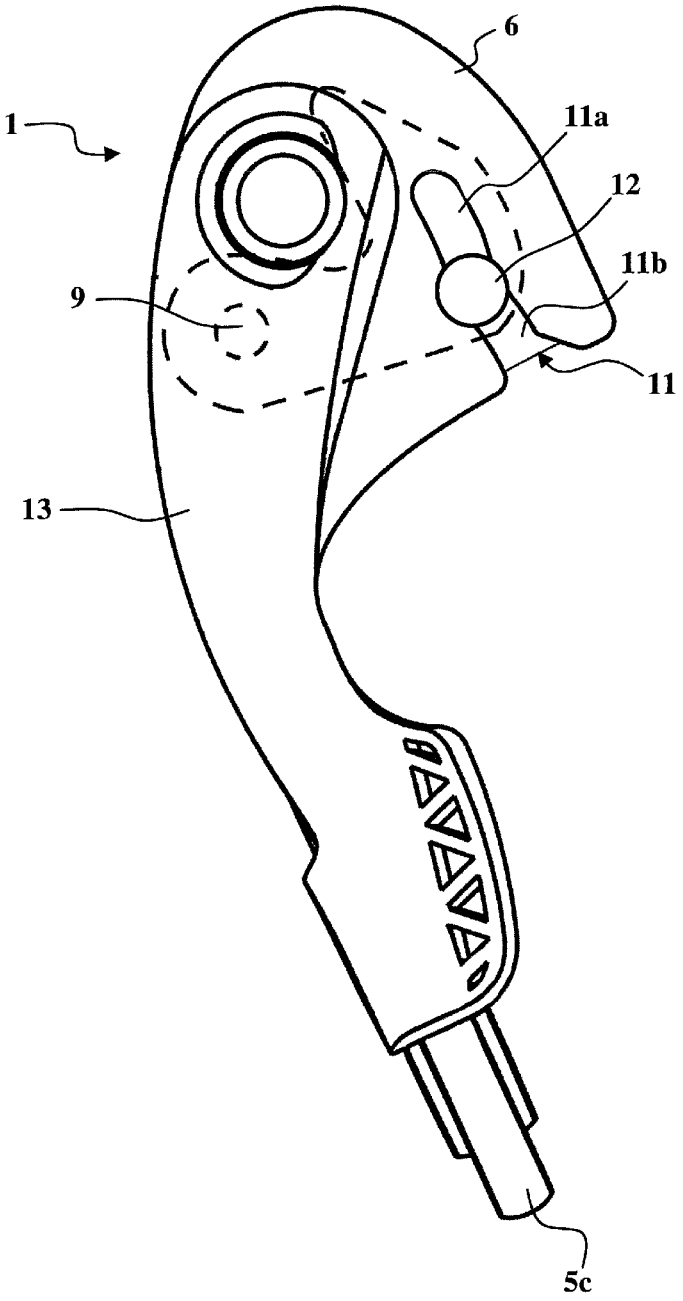

A lever return spring 13*d* returns the lever to the position of rest which is illustrated in particular in FIGS. 8 and 9, in which the lever is oriented along the connection body 4*a*, away from the second cam lug 12.

A cam return spring 14 permanently thrusts the cam 4*d* in its movement between the first and second lateral guide flanges 6 and 7 for the rope, in the direction which brings the cam 4*d* towards the braking nose 4*e*.

FIGS. 1, 3, 5 and 6 are now considered more particularly, in order to describe the passage of the rope 3 on the transverse path 8 for passage of the rope.

As can be seen in these figures, the transverse path 8 for passage of the rope is delimited by the first lateral guide flange 6 for the rope, by the second lateral guide flange 7 for the rope, by the braking nose 4*e*, by the cam 4*d*, and by the connection body 4*a*.

The transverse path 8 for passage of the rope extends between a path input 8*a* in the vicinity of the braking nose 4*e*, and a path output 8*b* opposite. Between the path input 8*a* and the path output 8*b*, an intermediate section 3C of the rope 3 passes along an intermediate section of path 8*c* between the braking nose 4*e* and the cam 4*d*.

Figure 5:
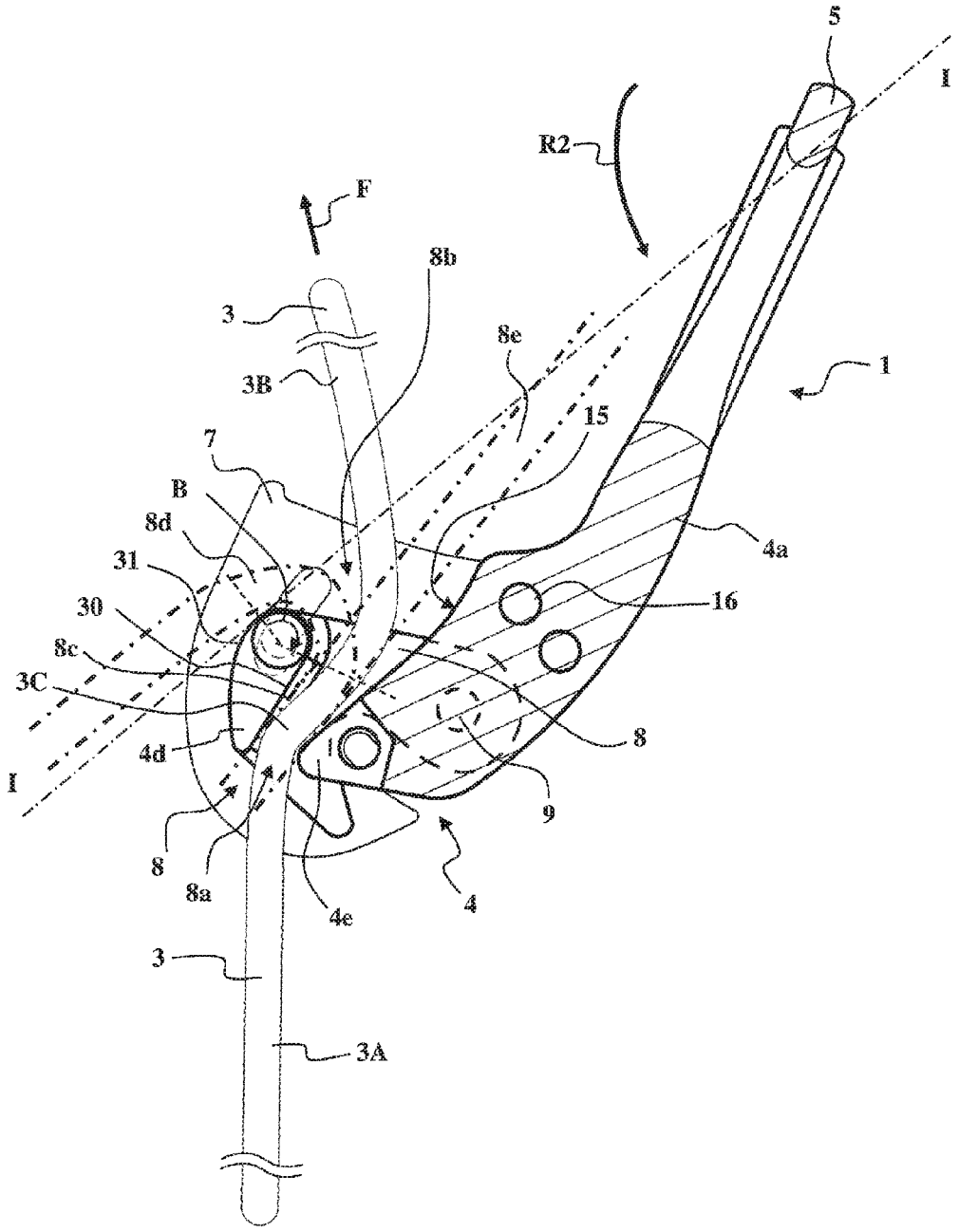
FIG. 5 is a view of the right side in cross-section according to the plane A-A in FIG. 1, when the descender-belay device is oriented in order to release the sliding of the rope.
Figure 6:
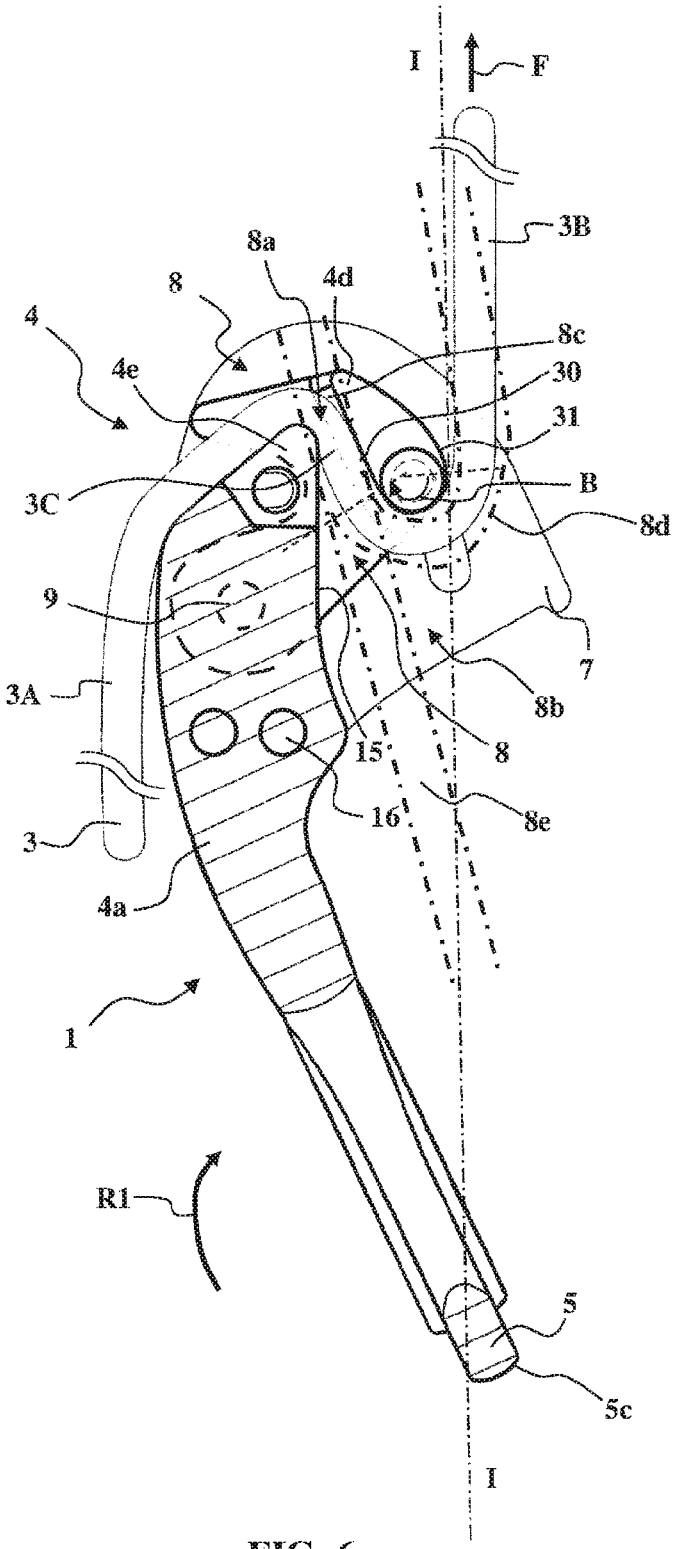
FIG. 6 is a side view in cross-section according to the plane A-A with orientation of the descender-belay device which makes it possible to block the rope.

At the path input 8*a*, the input end 3A of the rope 3 can pass freely around the braking nose 4*e*, in order to adopt any orientation between a quasi-direct orientation as an extension of the section 3C trapped between the braking nose 4*e* and the cam 4*d* (see FIG. 5), and an orientation illustrated in FIG. 6, in which the input end 3A of the rope 3 passes around the braking nose 4*e*.

According to the present invention, the path output 8*b* is formed such as to modify the braking of the rope 3 according to the orientation of the output end 3B of the rope 3, between a blocking orientation, illustrated in FIG. 6, in which the output end 3B envelopes the cam 4*d*, and a release orientation, illustrated in FIG. 5, in which the output end 3B substantially extends the intermediate section 3C of rope between the cam 4*d* and the braking nose 4*e*. For this purpose, the path output 8*b* extends laterally according to a large opening, and widens opposite the intermediate section of path 8*c*, between the first and second lateral guide flanges 6 and 7 for the rope, from a blocking output portion 8*d* to a release output portion 8*e*.

As illustrated in FIG. 6, the cam 4*d* comprises a clamping section 30, which faces the braking nose 4*e*, and is followed by a convex guide section 31 which extends in the form of an arc, according to an angle B of more than 90°. The blocking output portion 8*d* envelops the cam 4*d* according to its convex guide section 31.

As also illustrated in FIG. 6, opposite the cam 4*d*, the path output 8*b* is limited by the connection body 4*a*, according to a guide surface 15 which defines the release output portion 8*e*. The release output portion 8*e* is substantially in line with the path input 8*a*, and with the intermediate section of path 8*c*, thus defining a substantially straight passage along which the output end 3B of the rope 3 can pass directly when it is itself in the release orientation illustrated in FIG. 5. In this case, the output end 3B of the rope 3 can slide from the path input 8*a* to the path output 8*b* by passing along the intermediate section 8*c*, without thrusting the cam 4*d* towards the braking nose 4*e*. On the contrary, the sliding of the rope 3 tends rather to thrust the cam 4*d* away from the braking nose 4*e*, as a result of the particular position of the rotational cam shaft 9.

Thus, as a result of the particular arrangement of the cam 4*d* and its rotational shaft 9 and as a result of the particular arrangement of the path output 8*b*, the cam 4*d* is arranged such that, when the output end 3B of the rope is in the blocking orientation and passes along the blocking output portion 8*d* whilst enveloping the cam 4*d*, tension of the output end 3B of the rope then thrusts the cam 4*d* towards the braking nose 4*e*, in such a way that, when the output end 3B of the rope is in the release orientation and passes along the release output portion 8*e* without enveloping the cam 4*d*, tension of the output end 3B of the rope does not thrust the cam 4*d* towards the braking nose 4*e*, but on the contrary longitudinal sliding of the rope 3 thrusts the cam 4*d* away from the braking nose 4*e*.

During use of the self-blocking descender-belay device 1, the user orients the self-blocking descender-belay device 1 with respect to the rope, as illustrated in FIGS. 5 and 6.

In FIG. 6, the orientation of the self-blocking descender-belay device 1 is left free by the user around coupling means 5, and the device begins itself to rotate R1 towards a braking position, in which the connection device 4 is directed towards the output end 3B, thus exerting braking on the rope 3. In this case, when traction F is exerted according to the traction axis I-I, between the output end 3B and the proximal end area 5*c* of the coupling means 5, the self-blocking descender-belay device 1 prevents sliding on the rope 3. For this purpose, as can be seen in FIG. 6, the output end 3B of the rope 3 passes around the cam 4*d*, and gives rise to rotation of the cam 4*d* around its rotational shaft 9, in the direction which brings it towards the braking nose 4*e*, such that the intermediate section 3C of the rope 3 is gripped between the cam 4*d* and the braking nose 4*e*, thus preventing sliding of the rope 3.

In FIG. 5, the self-blocking descender-belay device 1 is deliberately brought into the release position, in which the connection device 4 is pushed back opposite the output end 3B by thrusting R2 by the user, thus making it possible to release the sliding of the rope 3. In this case, the input end 3A, the intermediate section 3C and the output end 3B are substantially aligned with one another, in other words the rope 3 passes along the transverse path 8 for passage of the rope directly. This is made possible by the fact that the guide surface 15 is substantially parallel to the traction axis I-I, thus allowing the output end 3B to be brought closer to the coupling means 5. In this case, when it slides towards the path output 8*b*, the rope 3 slides between the braking nose 4*e* and the cam 4*d*, without thrusting the cam 4*d* around its rotational shaft 9 towards the braking nose 4*e*. Only the action of the cam return spring 14 (FIG. 4) thrusts the cam 4*d* back towards the braking nose 4*e* by gripping the rope 3 slightly, but this slight gripping does not prevent the sliding of the rope 3 towards the path output 8*b*.

Preferably, the user assists the sliding of the rope 3 further by pulling the output end 3B manually parallel to the traction axis I-I, in which orientation the braking is minimal.

By using the blocking position in FIG. 6 and the sliding position in FIG. 5, the user can, for example, secure a climber whose progress requires the rope 3 to slide, and who must be retained safely if he falls, i.e. during traction of the rope according to the arrow F as indicated in FIG. 6. For the blocking, the user simply releases the self-blocking descender-belay device 1, which, from the release position in FIG. 5, pivots automatically to the blocking position in FIG. 6 under the effect of the traction of the rope 3 according to the arrow F, with the traction axis I-I then being oriented in line with the output end 3B of the rope 3.

Figure 7:
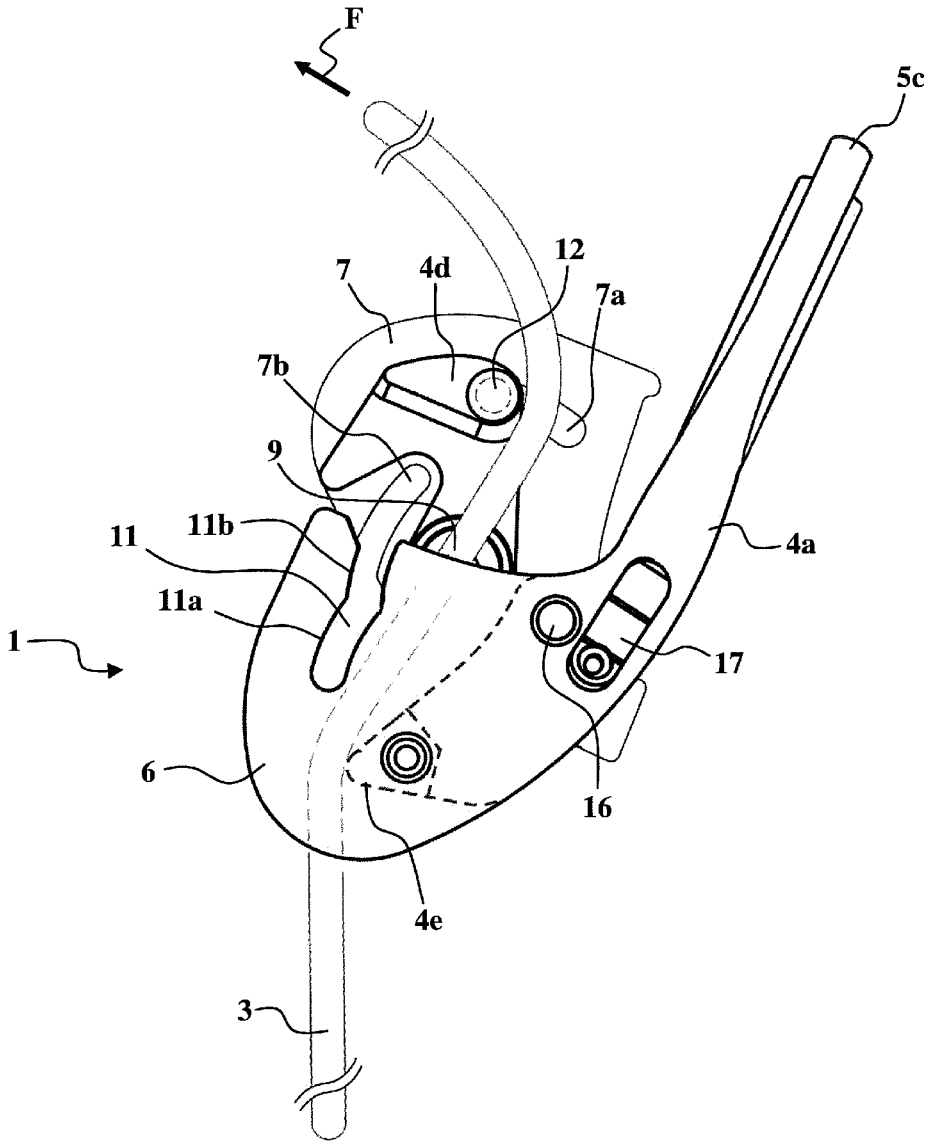
FIG. 7 is a view of the right side of the descender-belay device in FIG. 1, with the lever raised and the second lateral guide flange displaced into the spaced position, for putting into place and removal of a rope.

In order to allow the rope 3 to be put into place and removed, the second lateral guide flange 7 for the rope can be displaced between a spaced position, illustrated in FIG. 7, and a closed position illustrated in FIGS. 5 and 6. Between these two positions, the second lateral guide flange 7 for the rope pivots on the connection body 4*a*, around a flange shaft 16.

As can be seen in FIGS. 5 to 7, on the second lateral guide flange 7 for the rope, the flange shaft 16 is offset relative to the cam shaft 9, in the direction of the coupling means 5.

In the closed position illustrated in FIGS. 5 and 6, the two lateral guide flanges 6 and 7 for the rope are opposite one another, and trap the rope 3 in the transverse gap 8 for passage of the rope, between the connection body 4*a*, the braking nose 4*e* and the cam 4*d*. On the other hand, in the spaced position, the second lateral guide flange 7 for the rope is pivoted sufficiently around the flange shaft 16 for the cam 4*d* to be spaced from the first lateral guide flange 6 for the rope, and allows the rope 3 to be put into place and removed as illustrated in FIG. 7.

As can be seen in FIG. 6, in the braking position in which the cam 4*d* clamps the rope 3 against the braking nose 4*e*, the cam 4*d* is entirely accommodated in the transverse gap 8 for passage of the rope, the contour of the cam 4*d* being recessed from the contour of the lateral guide flanges 6 and 7 for the rope.

For safety reasons, it is important to prevent selectively the free rotation of the second lateral guide flange 7 for the rope towards its spaced position, in order to avoid untimely output of the rope 3 from the self-blocking descender-belay device 1. For this purpose, a first locking means consists of providing the guide path 11 of the second cam lug 12 with a particular form, as illustrated in FIGS. 2, 4, 8, 9, and 10.

In this case, the guide path 11 comprises two successive sections, i.e.:

- a first guide section 11*a* in the form of an arc of a circle centered on the rotational cam shaft 9, such that the second cam lug 12 can follow this first section 11*a* during the movement of rotation of the cam 4*d*, in its habitual movements of being brought closer to the braking nose 4*e* and moved away from it, for the clamping or release of the rope 3;
- a second guide section 11*b* in the form of an arc of a circle centered on the flange shaft 16, which permits the orientation of the second cam lug 12 during the pivoting of the second lateral guide flange 7 for the rope to its spaced position;
- the two guide sections 11*a* and 11*b* being connected according to an angle A which is not zero.

Figure 10:
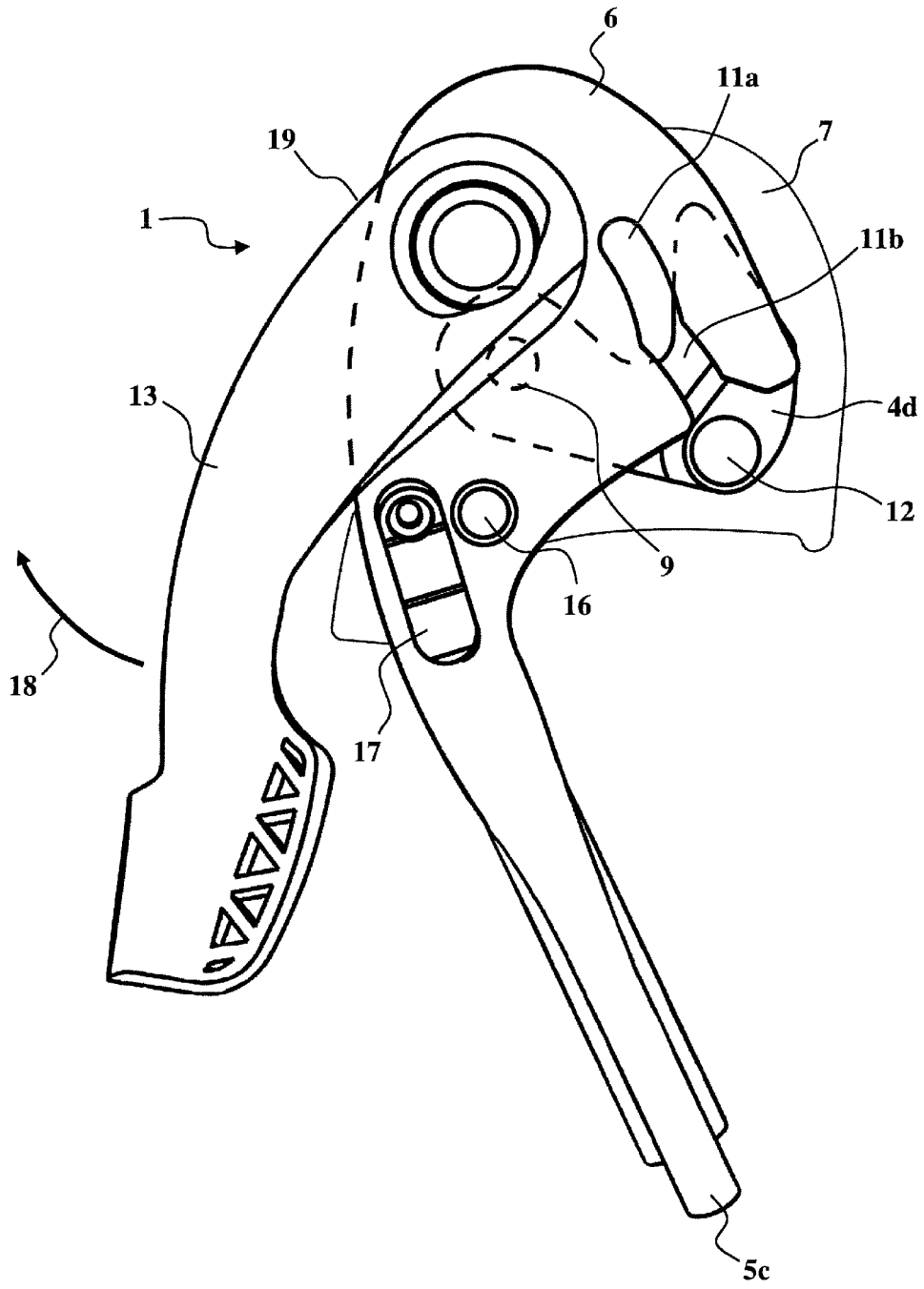

In this case, for as long as the cam 4*d* is at the bottom of the guide path 11, to which it is thrust back by the cam return spring 14, the second cam lug 12 prevents any pivoting of the second lateral guide flange for the rope around the rivet 16, which itself is structured in order to constitute the flange shaft 7, since the first guide section 11*a* is not centered on this flange shaft 16. The opening of the self-blocking descender-belay device 1 by pivoting of the second lateral guide flange 7 for the rope is possible only by means of a double manoeuvre, i.e. a first pivoting of the cam 4*d* around its rotational cam shaft 9, in order to bring the second cam lug 12 to the start of the second guide section 11*b*, then a movement of rotation of the second lateral guide flange 7 for the rope around its flange shaft 16. FIGS. 8 and 9 illustrate respectively the start and end of this first movement. FIGS. 9 and 10 illustrate respectively the start and end of the second movement.

An additional safety device can be provided in order to prevent untimely opening of the self-blocking descender-belay device 1. This then consists of providing a lock which can be activated by an unlocking button 17, the lock being arranged between the second lateral guide flange 7 for the rope and the connection body 4*a*. In this case, a third manoeuvre is necessary in order to ensure the unlocking, by action on the unlocking button 17, by pivoting of the cam 4*d*, then by pivoting of the second lateral guide flange 7 for the rope.

The structure and function of the lever 13 are now considered in relation to FIGS. 1, 4, 8 and 10.

This lever 13 is used when the self-blocking descender-belay device 1 is oriented as illustrated in these figures, with the coupling means 5 facing downwards, and with the braking nose 4*e* facing upwards. The self-blocking descender-belay device 1 is then used as a descender device, in order to brake the progression of the user's descent down the rope 3, or as a belay device in order to brake the paying-out of the rope which is retaining a climber during his descent.

The lever 13 is returned to the position of rest illustrated in FIGS. 1 and 8 by the lever return spring 13*d* (FIG. 4). In this position, the lever 13 is spaced from the second cam lug 12, thus allowing the cam 4*d* to be displaced under the action of the cam return spring 14 and the rope 3.

The self-blocking descender-belay device 1 is then initially in the blocking position illustrated in FIG. 6, with the user being coupled to the coupling means 5, the output end of the rope 3B being coupled to a fixed high point. Since the self-blocking descender-belay device 1 is oriented as shown in the figure, the cam 4*d* is thrust back towards the braking nose 4*e*, and prevents the sliding of the rope 3.

Since the user is suspended by the coupling means 5, it would not be possible for him to incline the self-blocking descender-belay device 1 towards the position of release as illustrated in FIG. 5, in order to permit the sliding of the rope 3.

In the descender function, it is then necessary to manoeuver the lever 13 in order to modify the braking on the rope 3. For this purpose, by means of the rotation of the lever 13 in the direction of the arrow 18 illustrated in FIG. 10, after rotation of more than half a turn, the outer ridge 19 of the lever 13 abuts the second cam lug 12, and thus makes it possible to thrust the cam 4*d* back spaced from the braking nose 4*e* by rotation around the rotational cam shaft 9. The user can thus regulate the braking on the rope 3.

As can be seen in the figures, in the position of rest the lever 13 covers the unlocking button 17, thus forming an additional safety device to prevent the unlocking of the second lateral guide flange 7 for the rope.

Figure 11:
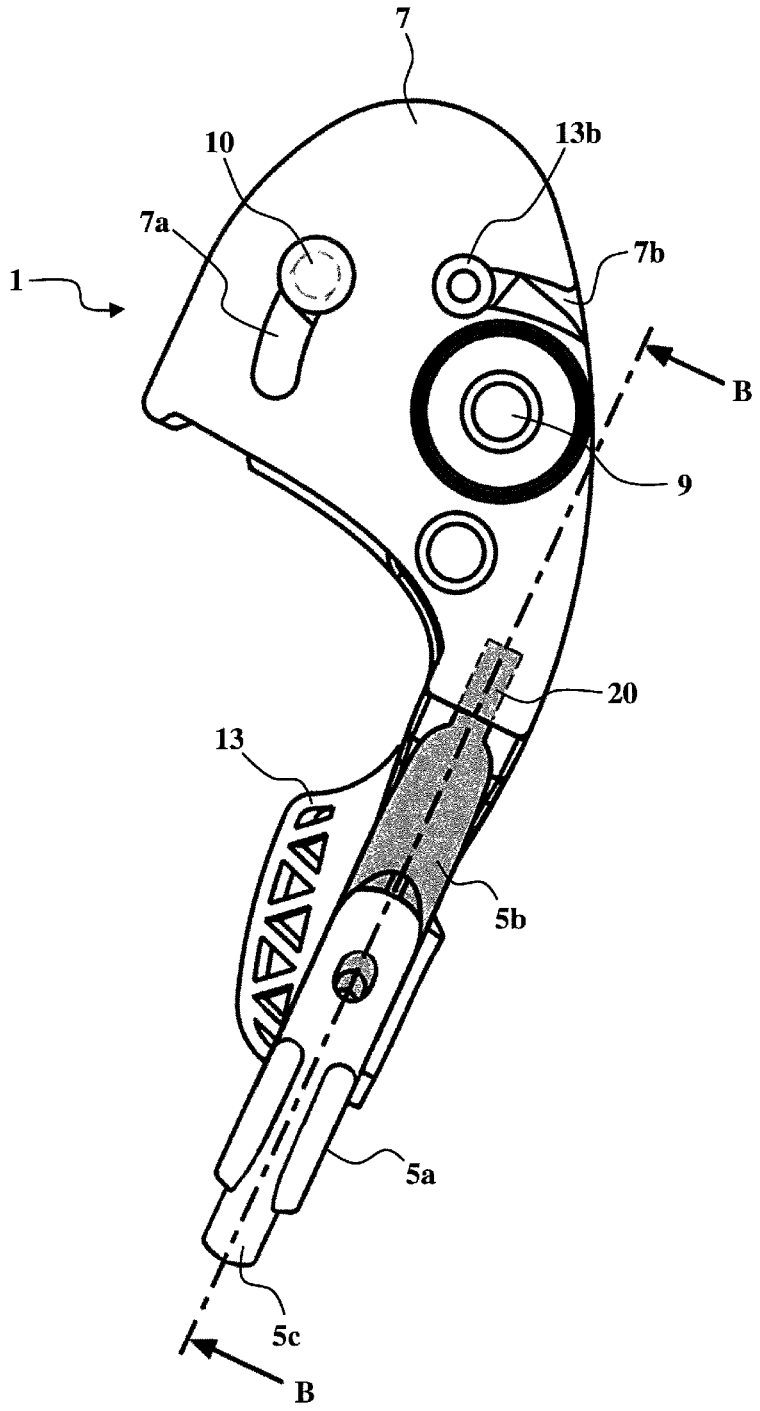
FIG. 11 is a view of the left side of the descender-belay device in FIG. 1.
Figure 12:
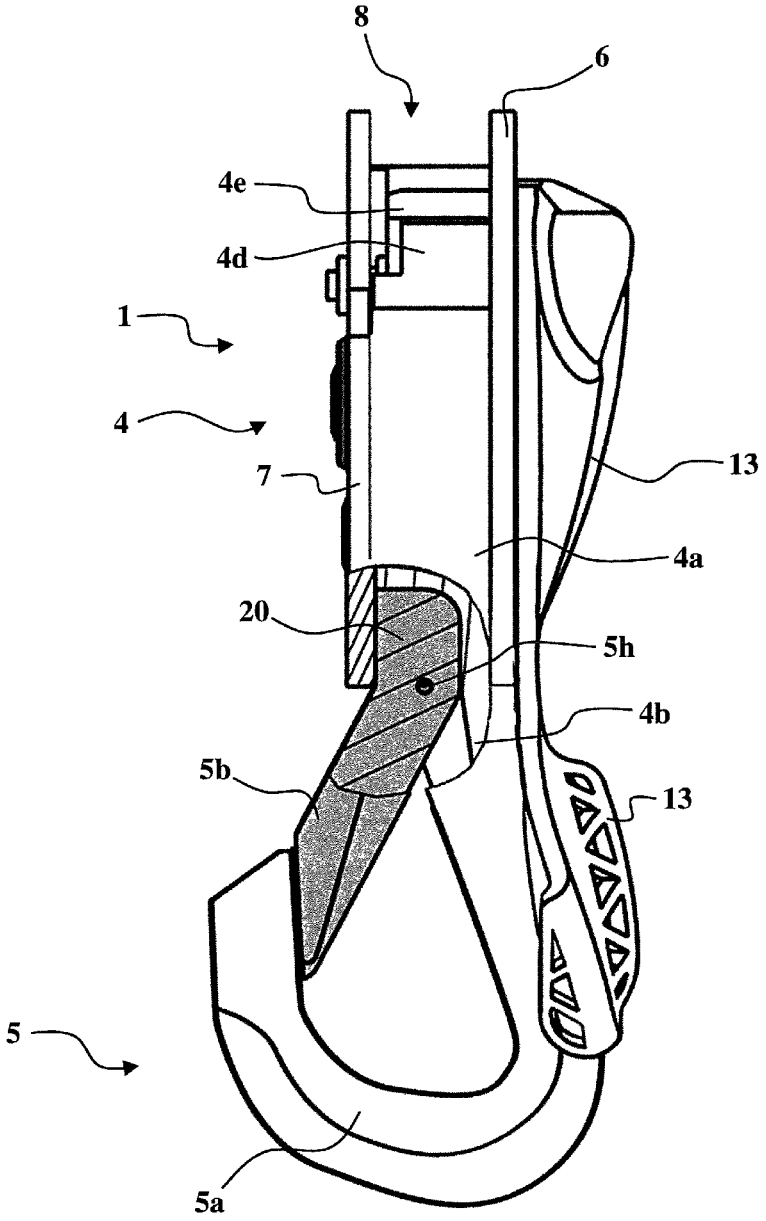
FIG. 12 is a cross-section according to the plane B-B in FIG. 11, illustrating the locking of a finger for closure of the coupling means.

FIGS. 11 and 12 are now considered, which illustrate a detail of an embodiment of the coupling means 5 and their locking means.

In this case the closure finger 5*b* which is articulated on the connector body 5*a* according to the articulation shaft 5*h* comprises a locking segment 20 which extends the closure finger 5*b* beyond the articulation shaft 5*h*. In the closed position as illustrated in the figures, the second lateral guide flange 7 for the rope covers this locking segment 20, thus preventing the pivoting of the closure finger 5*b* towards the inner space of the connector body 5*a*, i.e. thus preventing the opening of the coupling means 5. By this means, the second lateral guide flange 7 for the rope itself constitutes a means for locking the coupling means 5, such that the user cannot uncouple himself until the rope has been withdrawn after pivoting of the second lateral guide flange 7 for the rope to its spaced position.

The present invention is not limited to the embodiments which have been explicitly described, but includes the various variants and generalisations contained within the scope of the following claims.

The invention claimed is:

1. A self-blocking descender-belay device to control a pay-out of a rope, said self-blocking descender-belay device comprising:

a first lateral guide flange for the rope, wherein said first lateral guide flange is integral with a braking nose, a second lateral guide flange for the rope, a path for passage of the rope, said path having an intermediate section, said path separating said second lateral guide flange from said first lateral guide flange, said second lateral guide flange is configured to move between a spaced position and a closed position, wherein the spaced position is configured to allow the rope to be removed and placed into the path, and wherein the closed position is configured to trap the rope within the path for passage of the rope, a cam which is engaged between the first and second lateral guide flanges for the rope, wherein the cam is configured to be mobile by moving towards and away from the braking nose, said cam being separated from said braking nose by the intermediate section, a cam maneuvering unit, which can be activated by a user in order to displace the cam away from the braking nose, a cam return spring, in order to thrust the cam towards the braking nose, said path for passage of the rope extending on both sides of the intermediate section of said path, between a path input and a path output, wherein said path input is in a vicinity of the braking nose, the path output comprising a blocking output portion which passes around the cam, wherein an output end of the rope can pass along said blocking output portion and thus thrust the cam towards the braking nose, at least one flange selected from the group consisting of the first and second flanges extending longitudinally from a connection end area to a proximal end area, wherein the braking nose, the cam and said path for passage of the rope are situated in said connection end area, and wherein means for coupling a user to the self-blocking descender-belay device is situated in said proximal end area, wherein:

the path output extends laterally between the first and second flanges, from the blocking output portion to a release output portion, the release output portion is in a line with the path input and the intermediate section of path, the line configured to define a generally straight passage configured to allow the output end of the rope to pass directly, wherein the generally straight passage is configured to allow the rope to pass without thrusting the cam towards the braking nose, and the generally straight passage is configured to have the rope tend to thrust the cam away from the braking nose.

2. The self-blocking descender-belay device according to claim 1, wherein, in the movement of the cam towards and away from the braking nose, the cam is guided by guide slides.

3. The self-blocking descender-belay device according to claim 1, wherein:

the self-blocking descender-belay device has a rotational cam shaft, the cam is configured to move in rotation around said rotational cam shaft, the rotational cam shaft and the cam are situated respectively on both sides of the path, and the rotational cam shaft is closer to the proximal end area than is the cam.

4. The self-blocking descender-belay device according to claim 3, wherein the cam is supported by the second lateral guide flange for the rope.

5. The self-blocking descender-belay device according to claim 4, wherein:

the cam is associated with a first cam lug, and the first cam lug is configured to move in an aperture provided in the second lateral guide flange for the rope.

6. The self-blocking descender-belay device according to claim 3, wherein:

the cam is associated with a second cam lug, the second cam lug is configured to move on a guide path provided in the first lateral guide flange, said guide path comprises a first section for guiding according to the movement of rotation of the cam on the second flange around the rotational cam shaft, said guide path comprises a second section for guiding according to a movement of rotation of the second flange relative to the first flange around a flange shaft, the rotational cam shaft and the flange shaft being spaced apart from one another, and the second section for guiding being connected to the first section for guiding by an angle which is not zero.

7. The self-blocking descender-belay device according to claim 6, additionally comprising a button for unlocking of the second lateral guide flange relative to the first lateral guide flange.

8. The self-blocking descender-belay device according to claim 1, wherein:

the cam maneuvering unit comprises a lever which is articulated on one of the lateral guide flanges, the lever is connected mechanically to the cam and is configured to be activated by a user and thus to displace the cam away from the braking nose.

9. The self-blocking descender-belay device according to claim 7, wherein:

the cam maneuvering unit comprises a lever which is articulated on one of the lateral guide flanges, the lever is connected mechanically to the cam and is configured to be activated by a user and thus to displace the cam away from the braking nose, wherein the button is covered by the lever when the lever is at rest.

10. The self-blocking descender-belay device according to claim 1, wherein:

the cam is configured to be mobile by moving towards a braking position, when in the braking position the cam clamps a rope against the braking nose, when in the braking position the cam is entirely accommodated between the first and second lateral guide flanges.

* * * * *